United States Patent [19]

Sung et al.

[11] 4,078,901

[45] Mar. 14, 1978

[54] DETERGENT FUEL COMPOSITION

[75] Inventors: Rodney L. Sung, Fishkill; Peter Dorn, Lagrangeville; William P. Cullen; Raymond C. Schlicht, both of Fishkill, all of N.Y.

[73] Assignee: Texaco Inc., New York, N.Y.

[21] Appl. No.: 753,654

[22] Filed: Dec. 20, 1976

[51] Int. Cl.[2] ..... C10L 1/22

[52] U.S. Cl. ..... 44/64; 44/66

[58] Field of Search ..... 44/64, 66; 260/404.5 H

[56] References Cited

U.S. PATENT DOCUMENTS

| | | | |
|---|---|---|---|
| 3,485,806 | 12/1969 | Bloomquist et al. | 71/85 |
| 3,704,109 | 11/1972 | Newman et al. | 44/66 |
| 3,706,800 | 12/1972 | Hartlage et al. | 260/404.5 H |
| 3,773,722 | 11/1973 | Dexter | 44/64 |
| 3,897,348 | 7/1975 | Atkinson | 260/404.5 H |
| 3,985,807 | 10/1976 | Grimm et al. | 260/404.5 H |

*Primary Examiner*—Daniel E. Wyman
*Assistant Examiner*—Mrs. Y. Harris-Smith
*Attorney, Agent, or Firm*—Thomas H. Whaley; Carl G. Ries; James J. O'Loughlin

[57] ABSTRACT

Motor fuel composition comprising a mixture of hydrocarbons in the gasoline boiling range containing a minor detergent amount of an aminimide represented by the formula:

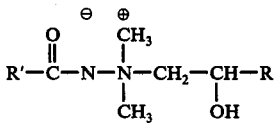

in which R′ is a hydrocarbon radical having from about 10 to 24 carbon atoms and R is hydrogen or a hydrocarbon radical having from 1 to 20 carbon atoms.

11 Claims, No Drawings

DETERGENT FUEL COMPOSITION

BACKGROUND OF THE INVENTION

1. Field of the Invention

Modern internal combustion engine design is undergoing important changes to meet new Federal standards concerning engine exhaust gas emissions. A major change in engine design recently adopted is the feeding of blow-by gases from the crankcase zone of the engine into the intake air supply of the carburetor rather than venting these gases to the atmosphere as in the past. A further change being adopted involves the recycling of a part of the exhaust gases to the combustion zone of the engine in order to effect a more complete combustion and to further reduce objectionable exhaust emissions. The recycled gases contain substantial amounts of deposit-forming substances which promote the formation of deposits in and around the throttle plate area of the carburetor. These deposits have the effect of restricting the flow of air through the carburetor at idle and at low speeds so that an over-rich fuel mixture results. This condition produces rough engine idling and stalling and serves to increase the harmful exhaust emissions which the engine design changes were intended to overcome.

2. Description of the Prior Art

U.S. Pat. Nos. 3,628,992 and 3,640,676 disclose the use of aminimides for the purpose of shrink-proofing wool and for the bonding of rubber. Detergent motor fuel compositions are the subject of U.S. Pat. Nos. 3,926,578; 3,907,516 and 3,905,781.

SUMMARY OF THE INVENTION

A novel motor fuel composition employing an aminimide additive has been discovered which exhibits outstanding carburetor detergency properties when employed in an internal combustion gasoline engine.

DESCRIPTION OF THE PREFERRED EMBODIMENTS

The additive which is effective as a carburetor detergent in the motor fuel composition of the invention is an aminimide represented by the formula:

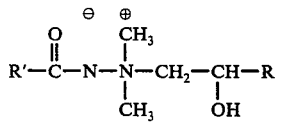

in which R′ is a hydrocarbon radical having from about 10 to 24 carbon atoms and R is hydrogen or a hydrocarbon radical having from 1 to about 20 carbon atoms. A preferred aminimide is one in which R′ is a hydrocarbon radical having from 14 to 20 carbon atoms and R is hydrogen or a hydrocarbon radical having from 1 to 4 carbon atoms. It is understood that R′ and R are monovalent hydrocarbon radicals and that they can be saturated or unsaturated radicals. The most preferred aminimides are those in which R′ has from 16 to 18 carbon atoms and R is hydrogen.

A general procedure for preparing aminimides from the corresponding acid hydrazide by quanternization followed by treatment with a base has been diclosed in U.S. Pat. Nos. 3,450,673; 3,485,806 and 3,628,992. The reaction steps for producing an aminimide can be represented by the following formulas in which R and R′ have the values noted above, and R″ is a lower alkyl radical in the fatty acid ester employed.

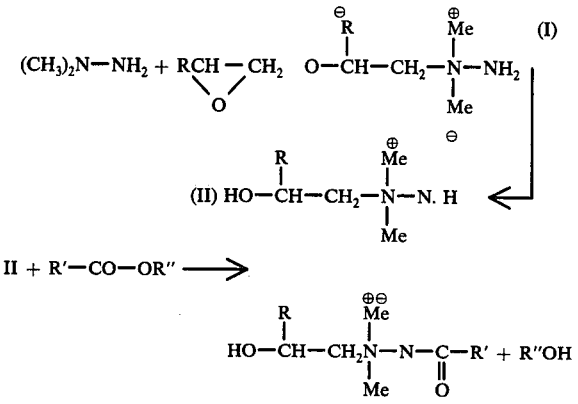

Aminimide

The following examples illustrate the preparation of the aminimides of the invention.

EXAMPLE I TALLOW AMINIMIDE

A mixture of 44g. (1mole) of ethylene oxide, 60 g. (1 mole) of 1,1-dimethyl hydrazine and 305g (1 mole) of the ethyl esters of a mixture of fatty acids derived from tallow is refluxed in 90 g. of ethyl acetate and 500 ml. of benzene for about 6 hours. The reaction product is then stripped of solvent and byproduct ethyl alcohol under vacuum to leave a substantial yield of a tallow derived aminimide.

EXAMPLE II COCONUT AMINIMIDE

A mixture of ethylene oxide (44 g. 1 mole), 1,1-dimethyl hydrazine (60 g. 1 mole) and 252 g (1 mole) of the ethyl esters of a mixture of fatty acids derived from coconut oil is refluxed in 88 g. of ethyl acetate and 500 ml of benzene for about 6 hours. The reaction mixture is then stripped of solvent and byproduct alcohol under a vacuum to leave a substantial yield of the coconut derived aminimide.

EXAMPLE III

Similar tallow, cocoa, soya and fatty acid aminimides are prepared from the fatty acid moiety, ethylene or propylene oxide and 1,1-dimethyl hydrazine following the procedure of Example I above.

Examples of suitable motor fuel detergents of the invention include:

N-2-hydroxyethyl-N,N-dimethyl-N′-stearaminimide
N-2-hydroxyethyl-N,N-dimethyl-N′-laurylaminimide
N-2-hydroxyethyl-N,N-dimethyl-N′-palmitaminimide
N-2-hydroxypropyl-N,N-dimethyl-N′-stearaminimide
N-2-hydroxypropyl-N,N-dimethyl-N′-oleylaminimide
N-2-hydroxypropyl-N,N-dimethyl-N′-arachidaminimide
and N-2-hydroxybutyl-N,N-dimethyl-N′-myristaminimide.

A minor amount of the prescribed aminimide of the invention in a motor fuel base will provide an effective detergent gasoline composition. In general, an effective concentration of the additive for carburetor detergency ranges from about 0.001 to 0.5 weight percent. A preferred concentration is an amount ranging from about 0.01 to 0.2 weight percent with the particularly preferred concentration range being from 0.02 to 0.1 weight percent. The limits of the preferred concentration range (0.01 to 0.2) correspond respectively to about 25 and 500 PTB (pounds of additive per 1000 barrels of gasoline).

Any gasoline suitable for a spark-ignited, internal combustion gasoline engine can be used in the practice of this invention. In general, the base fuel will consist of a mixture of hydrocarbons in the gasoline boiling range, i.e., boiling from about 80° to 450° F. The hydrocarbon components can consist of paraffinic, naphthenic, aromatic and olefinic hydrocarbons, or any mixture of these. This gasoline can be obtained naturally or it can be produced by thermal or catalytic cracking and/or reforming of petroleum hydrocarbons. The base fuel will generally have a Research Octane Number above 80 ranging up to about 102. Most present day gasolines have Research Octane Numbers ranging from about 90 to 100 R.O.N.

It is understood that the finished gasoline can contain any of the additives conventionally employed in motor fuel compositions. Thus, the finished fuel composition can contain tetraalkyl lead or other anti-knock compounds, anti-icing additives, corrosion inhibitors, deposit modifiers, upper cylinder lubricating oils and the like.

A motor fuel composition containing the prescribed aminimide of the invention was tested for its effectiveness as a carburetor detergent in the Chevrolet Carburetor Detergency Test. The Base Fuel employed in these examples was a premimum grade gasoline having a Research Octane Number of about 99 containing 3 cc of tetraethyl lead per gallon. This gasoline consisted of about 23 percent aromatic hydrocarbons, 9 percent definic hydrocarbons and 68 percent paraffinic hydrocarbons and boiled in the range from about 90° to 375° F.

CHEVROLET CARBURETOR DETERGENCY TEST

This test is run on a Chevrolet V-8 engine mounted on a test stand using a modified four-barrel carburetor. The two secondary barrels of the carburetor are sealed and the feed to each of the primary barrels arranged so that separate fuels can be run in each barrel simultaneously. The primary carburetor barrels are also modified so that they have removable aluminum inserts in the throttle plate area in order that deposits formed on the inserts in this area can be conveniently weighed.

In the procedure designed to determine the effectiveness of an additive fuel to remove preformed deposits in the carburetor, the engine is run for a period of time, usually 24 to 48 hours, using the base fuel as the feed to both barrels with engine blow-by circulated to the air inlet of the carburetor. The weight of the deposits on both sleeves is determined and recorded. The engine is then cycled for 24 additional hours with a reference fuel being fed to one barrel, additive fuel to the other, and no blow-by to the carburetor air inlet. The inserts are then removed from the carburetor and weighed to determine the difference between the performance of the additive and non-additive fuels in removing the preformed deposits. After the aluminum inserts are cleaned, they are replaced in the carburetor and the process repeated with the fuels reversed in the carburetor to minimize differences in fuel distribution and barrel construction.

The motor fuels used as standards for comparison purposes in this test were commercial high octane premium gasolines containing highly effective carburetor detergents. The fuel composition representative of the invention consisted of the Base Fuel described above containing the indicated amounts of the additive of the invention. The results of this test are reported as the percent of carburetor deposits removed by the novel additive containing gasolines tested in comparison to commercial detergent gasolines in the same test.

The results of the Chevrolet Carburetor Detergency Tests are set forth in Table I below.

TABLE I

CHEVROLET CARBURETOR DETERGENCY TEST

| Run | Fuel | % Deposit Removed |
|---|---|---|
| 1. | Commercial Detergent Fuel A[a] | 41 |
| 2. | Commercial Detergent Fuel B[b] | 63 |
| 3. | Base Fuel + 75 PTB Of Tallow aminimide[c] | 64 |
| 4. | Base Fuel + 50 PTB of Tallow aminimide[c] | 62 |

[a]A commercial fuel containing approximately 15 PTB of a carburetor detergent additive.
[b]A commercial fuel containing approximately 175 PTB of a carburetor detergent additive.
[c]A commercial Tallow aminimide prepared from a mixture of fatty acids derived from Tallow similar to the aminimide of Example I.

A cocoaminimide prepared from a mixture of fatty acids derived from coconut oil in a manner similar to the preparation described in Example II was tested in the Chevrolet Carburetor Detergency Test in comparison to Commercial Detergent Fuel B. This fuel composition containing 100 PTB of the cocoaminimide was substantially equivalent to commercial Detergent Fuel B in this test.

The foregoing tests demonstrate the outstanding carburetor detergency properties of the fuel composition of the invention. This novel fuel composition is especially suitable for maintaining carburetor cleanliness and, as a result, lower exhaust emissions in the operations of a modern internal combustion gasoline engine.

We claim:

1. A motor fuel composition comprising a mixture of hydrocarbons in a gasoline boiling range containing from about 0.001 to 5.0 weight percent of an aminimide represented by the formula:

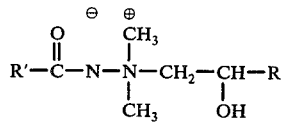

in which R′ is a hydrocarbon radical having from about 10 to 24 carbon atoms and R is hydrogen or a hydrocarbon radical having from 1 to about 20 carbon atoms.

2. A motor fuel composition according to claim 1 in which R′ is a hydrocarbon radical having from 14 to 20 carbon atoms and R is hydrogen or a hydrocarbon radical having from 1 to 4 carbon atoms.

3. A motor fuel composition according to claim 1, in which R′ is a hydrocarbon radical having from 16 to 18 carbon atoms and R is hydrogen.

4. A motor fuel composition according to claim 1, in which said aminimide is N-2-hydroxyethyl-N,N-dimethyl-N′-tallowaminimide.

5. A motor fuel composition according to claim 1, in which said aminimide is N-2-hydroxyethyl-N,N-dimethyl-N′-cocoaminimide.

6. A motor fuel composition according to claim 1, in which said aminimide is N-2-hydroxyethyl-N,N-dimethyl-N′-soyaaminimide.

7. A motor fuel composition according to claim 1, in which said aminimide is N-2-hydroxyethyl-N,N-dimethyl-N′-stearaminimide.

8. A motor fuel composition according to claim 1, in which said aminimide is N-2-hydroxyethyl-N,N-dimethyl-N′-laurylaminimide.

9. A motor fuel composition according to claim 1, in which said aminimide is N-2-hydroxyethyl-N,N-dimethyl-N′-palmitaminimide.

10. A motor fuel composition according to claim 1, containing from about 0.001 to 0.05 weight percent of said aminimide.

11. A motor fuel composition according to claim 2, containing from about 0.01 to 0.02 weight percent of said aminimide.

* * * * *